US009138059B2

(12) United States Patent
Kwok

(10) Patent No.: US 9,138,059 B2
(45) Date of Patent: Sep. 22, 2015

(54) FOLDABLE CHAIR

(75) Inventor: Ngai Mui Candy Kwok, Hong Kong (HK)

(73) Assignees: SHENZHEN ZHISHAN DINING MANAGEMENT LIMITED, Shenzhen (CN); Ngai Mui Candy Kwok, Hong Kong (HK)

( * ) Notice: Subject to any disclaimer, the term of this patent is extended or adjusted under 35 U.S.C. 154(b) by 0 days.

(21) Appl. No.: 14/111,160

(22) PCT Filed: Apr. 25, 2012

(86) PCT No.: PCT/CN2012/074667

§ 371 (c)(1), (2), (4) Date: Oct. 10, 2013

(87) PCT Pub. No.: WO2012/149876

PCT Pub. Date: Nov. 8, 2012

(65) Prior Publication Data

US 2014/0028060 A1 Jan. 30, 2014

(30) Foreign Application Priority Data

May 5, 2011 (CN) ..... 2011 2 0141277

(51) Int. Cl.

| | |
|---|---|
| ***A47C 4/04*** | (2006.01) |
| ***A47C 4/18*** | (2006.01) |
| ***A47C 7/40*** | (2006.01) |
| ***A47C 7/50*** | (2006.01) |

(52) U.S. Cl.

CPC ... *A47C 4/04* (2013.01); *A47C 4/18* (2013.01); *A47C 7/407* (2013.01); *A47C 7/50* (2013.01)

(58) Field of Classification Search

CPC ..... A47C 4/04; A47C 4/18
USPC ..... 297/52, 53, 56
See application file for complete search history.

(56) References Cited

U.S. PATENT DOCUMENTS

| | | | | | |
|---|---|---|---|---|---|
| 1,283,924 | A | * | 11/1918 | Rupp | 297/53 |
| 1,852,012 | A | * | 4/1932 | Hose | 297/344.26 |
| 2,042,886 | A | * | 6/1936 | Ferguson | 297/357 |
| 2,779,394 | A | * | 1/1957 | Csorgo | 297/53 |
| 3,009,739 | A | * | 11/1961 | Hamilton | 297/344.26 |
| 3,220,764 | A | * | 11/1965 | Duer | 297/56 |
| 5,415,455 | A | | 5/1995 | Geldbaugh | |
| 5,688,024 | A | * | 11/1997 | Arizpe-Gilmore | 297/217.1 |

(Continued)

FOREIGN PATENT DOCUMENTS

| | | | |
|---|---|---|---|
| CN | 87200697 | U | 11/1987 |
| CN | 201238819 | Y | 5/2009 |

(Continued)

*Primary Examiner* — Peter Brown

(57) ABSTRACT

The present invention provides a foldable chair includes a main body including a backrest, a seat, and legs; the backrest and the legs are connected to the seat; the seat includes a seating pad ring and a seating pad; the seating pad is placed on the seating pad ring; two folding parts extending upwards are formed on two sides of the seating pad ring; the folding part is provided with a receiving groove; two supports of the backrest are fixed to the folding parts; one end of the support is inserted into the receiving groove and detaches from the receiving groove when the support is moved; the folding part is provided with an opening, where the opening supports the support when the backrest is folded onto the seating pad. The foldable chair requires no bolt for use and packing, and does not occupy large storage.

1 Claim, 5 Drawing Sheets

(56) References Cited

U.S. PATENT DOCUMENTS

| | | | | |
|---|---|---|---|---|
| 6,340,205 | B1 * | 1/2002 | Battiston | 297/24 |
| RE37,927 | E * | 12/2002 | Fitch | 297/344.21 |
| 6,616,223 | B1 * | 9/2003 | Lin | 297/55 |
| 7,125,079 | B1 * | 10/2006 | Lee et al. | 297/353 |

FOREIGN PATENT DOCUMENTS

| | | | |
|---|---|---|---|
| CN | 201734253 | U | 2/2011 |
| JP | 8131288 | A | 5/1996 |

* cited by examiner

FOLDABLE CHAIR

BACKGROUND OF THE INVENTION

1. Field of the Invention

The present invention relates to a chair, and in particular, to a foldable chair.

2. Background

A chair is one of traditional seating devices for people and is widely used in offices, meeting rooms, libraries, hotels, and homes, which provides a comfortable seat for people during work, meeting, study, and leisure time. A manufacturer producing chairs, after making chairs into finished products, delivers them to distributors or users through transportation, loading, and unloading. In the prior art, during storage, transportation, and loading and unloading of chairs, a backrest of the chair occupies large storage, transportation, and loading and unloading space in spite of a structure in a shape of a flat plate, which results in increased storage, transportation, and loading and unloading costs to the disadvantage of competitiveness of the product on the market. In metropolises where housing prices keep rising, limited living space forces people to make the best of the space as much as possible or to design objects to occupy activity space as little as possible. Therefore, foldable furniture such as a chair, which is space-efficient and practical, is required.

SUMMARY OF THE INVENTION

The technical problem to be solved by the present invention is to provide a foldable chair which is convenient for assembling, space-efficient, and practical.

To solve the technical problem, the technical solution of the present invention is to provide a foldable chair, where a main body thereof includes a backrest, a seat, and legs; the backrest and the legs are connected to the seat; the seat includes a seating pad ring and a seating pad; the seating pad is placed on the seating pad ring; two folding parts extending upwards are formed on two sides of the seating pad ring; the folding part is provided with a receiving groove; two supports of the backrest are fixed to the folding parts; one end of the support is inserted into the receiving groove and detaches from the receiving groove when the support is moved; the folding part is provided with an opening, where the opening supports the support when the backrest is folded onto the seating pad.

Compared with the prior art, this foldable chair requires no bolt for use and packing, and does not occupy large storage, transportation, and loading and unloading space during storage, transportation, and loading and unloading of chairs, which reduces costs to improve the competitiveness of the product on the market, and is space-efficient and practical for use.

DETAILED DESCRIPTION OF THE INVENTION

The present invention is further described as follows with reference to the accompanying drawings.

Figure 1:
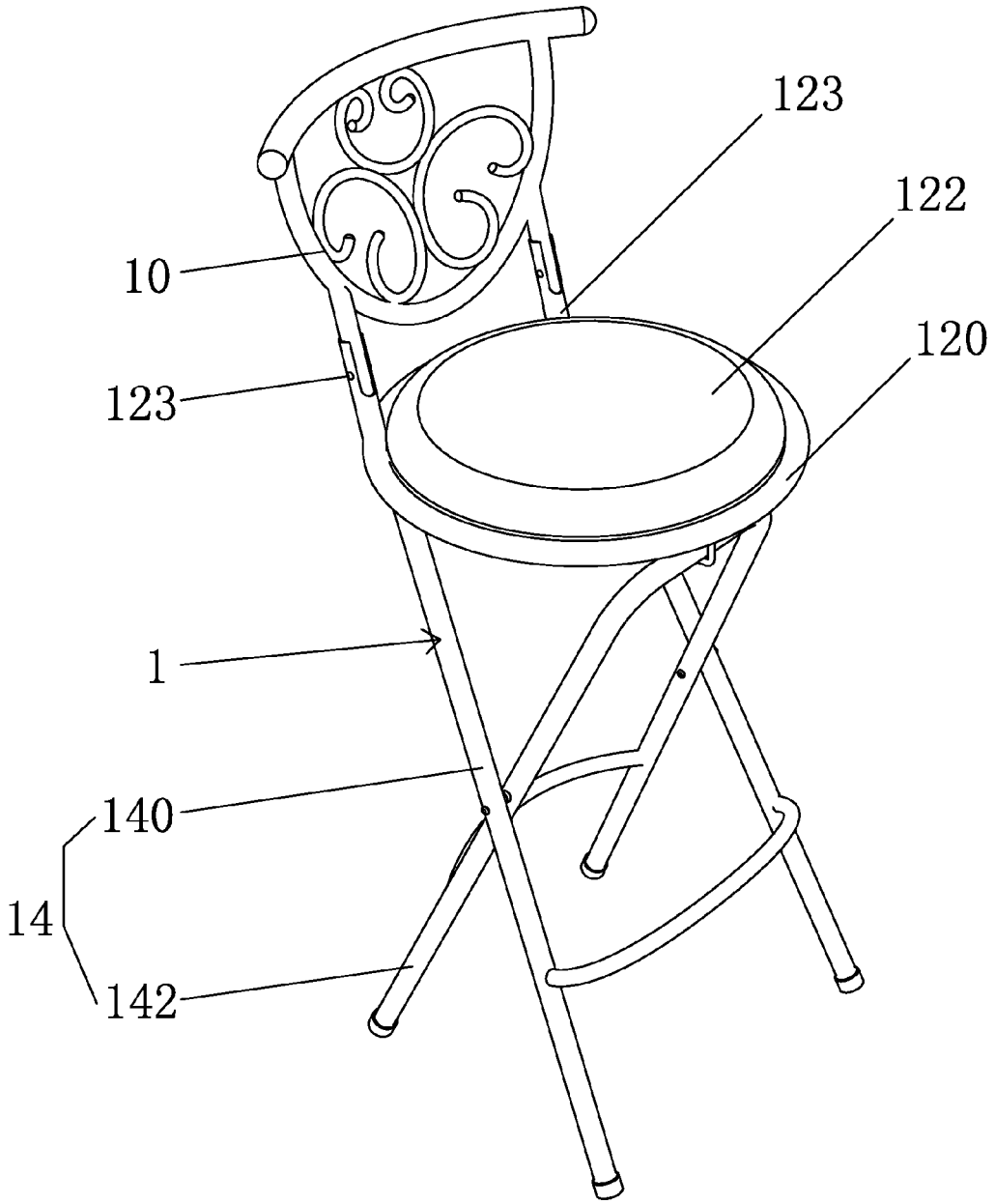
FIG. 1 is a schematic perspective view of a foldable chair according to the present invention.
Figure 2:
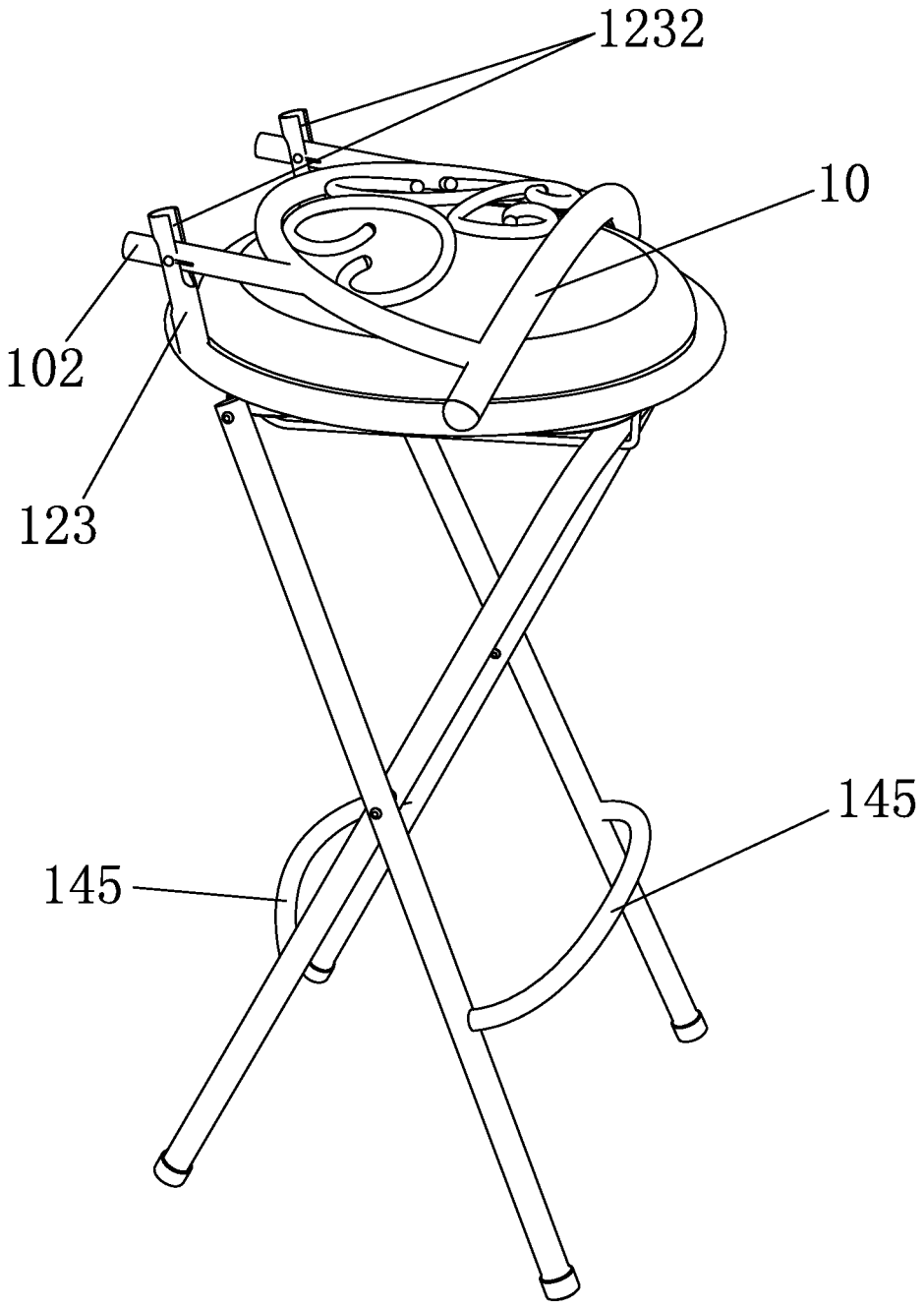
FIG. 2 is a schematic perspective view of a foldable chair according to the present invention after a backrest is folded.
Figure 3:
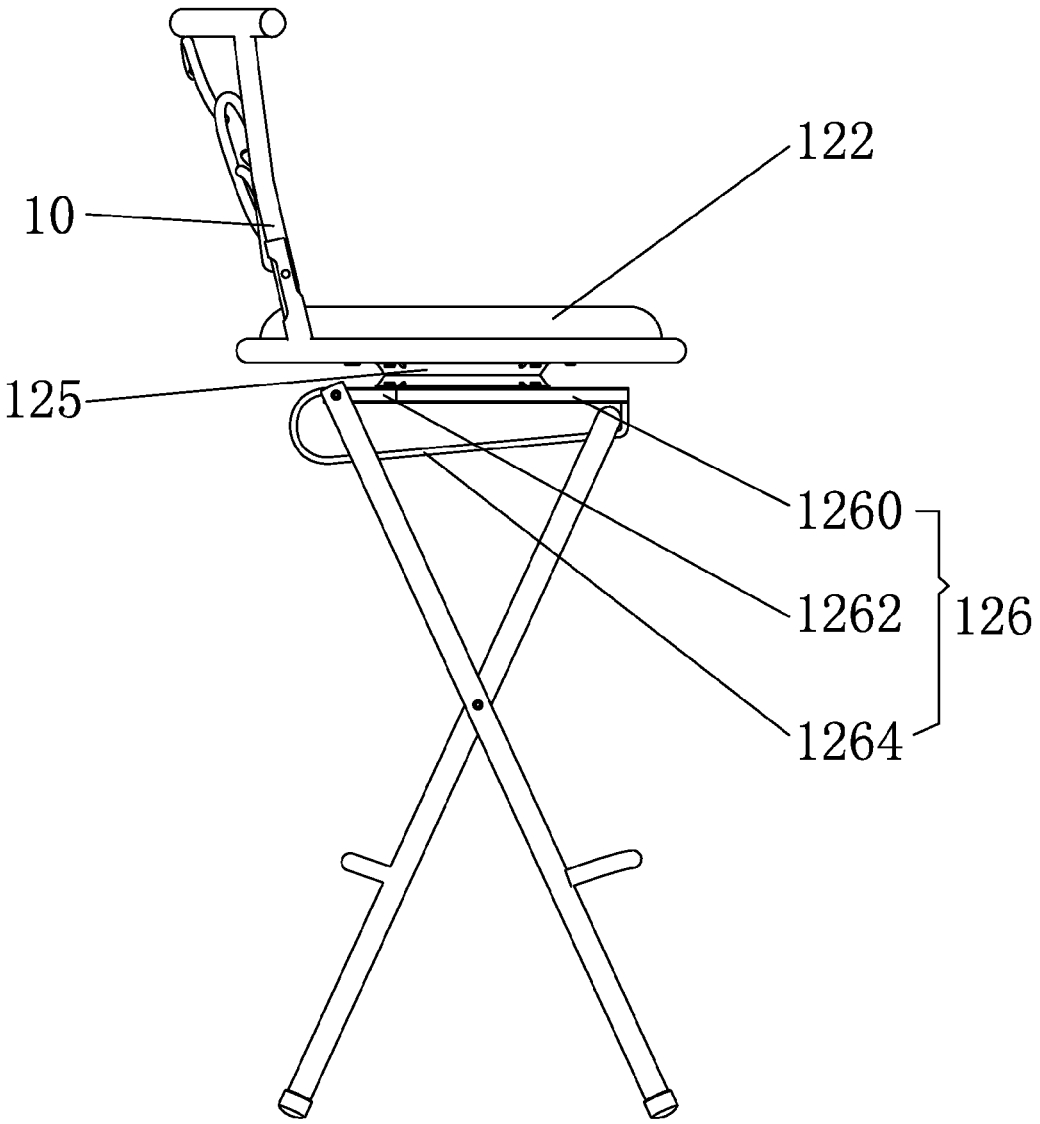
FIG. 3 is a schematic exploded perspective side view of a foldable chair according to the present invention.
Figure 4:
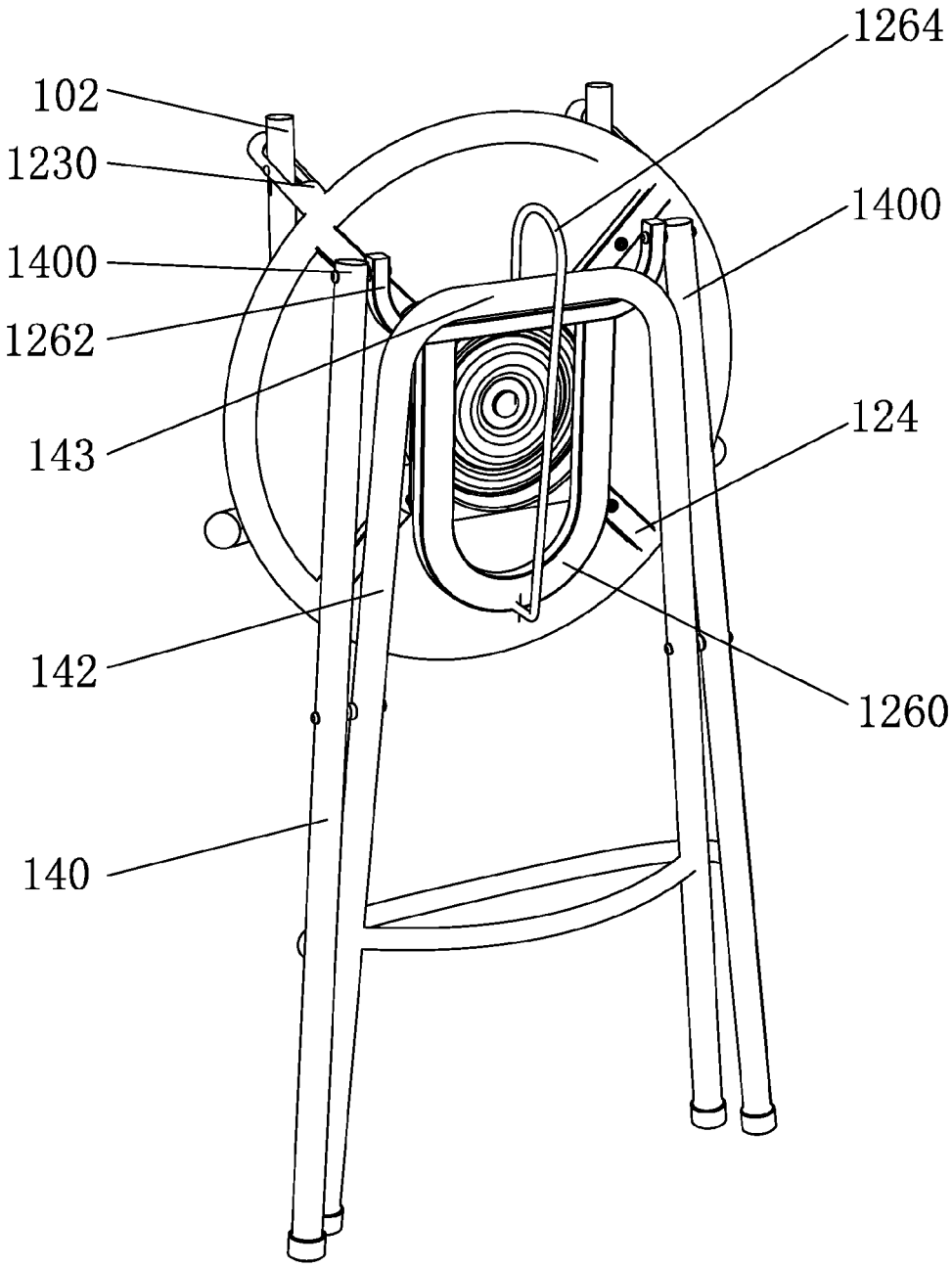
FIG. 4 is a schematic perspective view of a foldable chair according to the present invention after a backrest and legs are folded.
Figure 5:
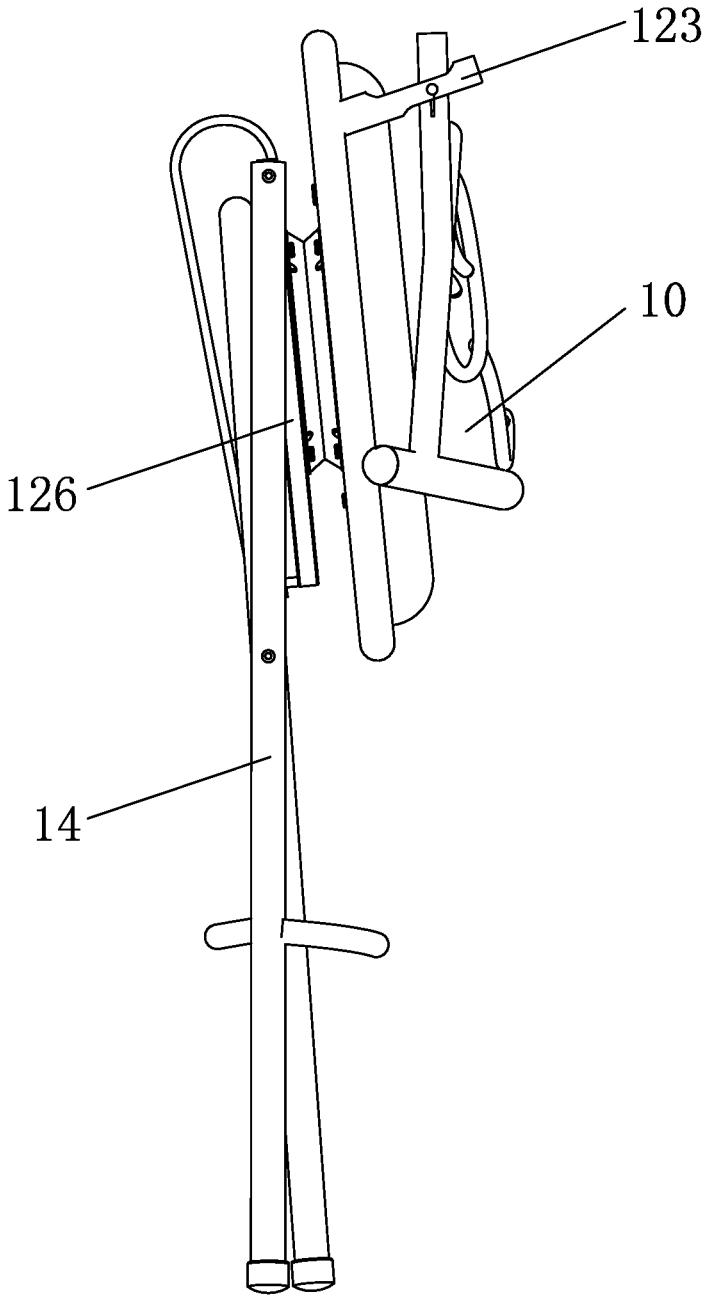
FIG. 5 is a schematic perspective side view of a foldable chair according to the present invention after a backrest and legs are folded.

Referring to FIG. 1 to FIG. 5, a main body 1 of a foldable chair according to the present invention includes a backrest 10, a seat 12, and legs 14, where the backrest 10 and the legs 14 are connected to the seat 12. The seat 12 includes a seating pad ring 120 and a seating pad 122, where the seating pad 122 is placed on the seating pad ring 120.

Two folding parts 123 extending upwards are formed on two sides of the seating pad ring 120. The folding part 123 is provided with a receiving groove 1230. The backrest 10 comprises two supports 102. Ends of two supports 102 of the backrest 10 are inserted into the receiving grooves 1230 of the folding parts 123, and are fixed to the folding parts 123 by using rivets. The support 102 is provided with an engaging slot (not shown in the figures) for receiving the rivet. By pulling the supports 102 upwards, the rivets move within the engaging slots of the supports 102, so that the ends of the supports 102 detach from within the receiving grooves 1230 as the support 102 is moved. The folding part 123 is provided an opening 1232 on a front side, where the opening 1232 supports the support 102 when the backrest 10 is folded onto the seating pad 122. When the support 102 is pressed, the support 102 is inserted into the opening 1232, one end of the support 102 detaches from the interior of the receiving groove 1230, and the opening 1232 supports the support 102.

The seating pad ring 120 is provided with a supporting rack 124, where the supporting rack 124 is in a shape of a cross. The supporting rack 124 is provided with a rotating disk 125, and the seating pad ring 120 may rotate on the rotating disk 125, thereby causing the main body 1 of the chair to rotate.

The rotating disk 125 is provided with a rotating-disk folding seat 126, where the rotating-disk folding seat 126 includes a U-shaped main body 1260, a connecting rack 1262, and a sliding bar 1264. The main body 1260 is installed on the rotating disk 125; the connecting rack 1262 is connected to one end of the main body 1260; and an end of the sliding bar 1264 is connected to the main body 1260, and the other end is connected to the connecting rack 1262. Two ends of the connecting rack 1262 are respectively connected to the supporting rack 124 by using rivets.

The legs 14 include two rear legs 140 and two front legs 142, where end portions 1400 of the two rear legs 140 are respectively connected to end portions of the connecting rack 1262 by using rivets and may rotate about the rivets. The two front legs 142 are connected at two ends to form a supporting bar 143, where the supporting bar 143 is placed on the sliding bar 1264 and may move on the sliding bar 1264, thereby causing the front legs 142 to move. A footrest 145 is provided between the two rear legs 140 and between the two front legs 142, where the footrests 145 are close to the ground for users to place their feet on for a rest.

When folding the backrest 10, the support 102 is pressed so that the backrest 10 rotates toward the seating pad 122, the support 102 is inserted into the opening 1232, and one end of the support 102 detaches from the interior of the receiving groove 1230; when the backrest 10 is completely placed on the seating pad 122, the opening 1232 supports the support 102, thereby implementing folding.

When folding the legs 14, the front legs 142 are pushed so that the supporting bar 143 moves on the sliding bar 1264 until the front legs 142 press against the rear legs 140, and the rear legs 140 are rotated so that the rear legs 140 and the front legs 142 press against the seating pad ring 120, thereby implementing folding.

The foldable chair requires no bolt for use and packing, and does not occupy large storage, transportation, and loading and unloading space during storage, transportation, and loading and unloading of chairs, which reduces costs to improve the competitiveness of the product on the market. It is space-efficient and practical for use.

The preferred embodiment is described above to enable those skilled in the art to manufacture and use the present invention. Those skilled in the art may derive various modifications to the embodiment according to the general principle provided herein without creative efforts. Therefore, the present invention is not limited to the embodiment illustrated herein, and shall be consistent with the maximum protection scope of the claims.

What is claimed is:

1. A foldable chair, comprising a main body (1) which comprises a backrest (10), a seat (12), and legs (14) comprising two rear legs (140) and two front legs (142); the seat (12) comprises a seating pad ring (120) and a seating pad (122) secured to the seating pad ring (120); further comprising:

two folding parts (123) extending upwards formed on two sides of the seating pad ring (120);

the folding part (123) comprising a receiving groove (1230); and the backrest (10) comprising two supports (102);

wherein two supports (102) of the backrest (10) is fixed to the folding parts (123); one end of the support (102) is inserted into the receiving groove (1230) and detaches from the receiving groove (1230) when the support (102) is moved; the folding part (123) is provided with an opening (1232) which supports the support (102) when the backrest (10) is folded onto the seating pad (122);

wherein the seating pad ring (120) is provided with a supporting rack (124), and the supporting rack (124) is provided with a rotating disk (125) for the seating pad ring (120) to rotate thereon;

wherein the rotating disk (125) is provided with a rotating-disk folding seat (126) comprising a main body (1260), a connecting rack (1262), and a sliding bar (1264); the main body (1260) is installed on the rotating disk (125); the connecting rack (1262) is connected to one end of the main body (1260);

one end of the sliding bar (1264) is connected to the main body (1260), and the other end is connected to the connecting rack (1262);

wherein end portions of the connecting rack (1262) are pivotally secured to end portions (1400) of the two rear legs (140);

wherein the two front legs (142) are connected at two ends to form a supporting bar (143), and the supporting bar (143) is placed on the sliding bar (1264) and moves on the sliding bar (1264); and wherein a footrest (145) is provided between the two rear legs (140) and between the two front legs (142), and the footrest (145) is close to the ground.

* * * * *